US006233888B1

(12) United States Patent
Wu

(10) Patent No.: US 6,233,888 B1
(45) Date of Patent: May 22, 2001

(54) CLOSURE ASSEMBLY FOR SPANNING A WALL OPENING

(76) Inventor: I-Shan Wu, No. 85, Pei-Chen St., Pu-Li Chen, Nan-Tou Hsien (TW)

( * ) Notice: Subject to any disclaimer, the term of this patent is extended or adjusted under 35 U.S.C. 154(b) by 0 days.

(21) Appl. No.: 09/474,281

(22) Filed: Dec. 29, 1999

(51) Int. Cl.[7] ..... E06B 1/04

(52) U.S. Cl. ..... 52/207; 52/204.66; 52/204.7; 52/656.4; 52/656.5; 49/504; 16/104

(58) Field of Search ..... 52/207, 204.51, 52/204.66, 204.68, 204.7, 656.7, 656.5, 656.4; 49/452, 453, 457, 504; 16/96 R, 103, 104

(56) References Cited

U.S. PATENT DOCUMENTS

| | | | | |
|---|---|---|---|---|
| 2,888,718 | * | 6/1959 | Francotte | 49/504 |
| 3,025,937 | * | 3/1962 | Finkel | 16/104 X |
| 3,027,606 | * | 4/1962 | Nicklas | 16/104 X |
| 3,491,483 | * | 1/1970 | Miller | 49/141 |
| 3,854,245 | * | 12/1974 | Anderson | 49/449 |

* cited by examiner

*Primary Examiner*—Beth A. Stephan
*Assistant Examiner*—Brian E. Glessner
(74) *Attorney, Agent, or Firm*—Jenkens & Gilchrist, P.C.

(57) ABSTRACT

A closure assembly includes an outer frame, panel members disposed within the outer frame, slidable rail units, pivot linking units, and locking members. The outer frame has top and bottom frame members formed with slide grooves. Each of the slidable rail units includes an upper rail disposed between the top frame member and an upper edge portion of a respective one of the panel members, and a lower rail disposed between the bottom frame member and a lower edge portion of the respective one of the panel members. Each of the upper and lower rails is provided with a rolling ball unit which extends slidingly into the slide groove unit in a respective one of the top and bottom frame members. The pivot linking units connect the upper and lower rails to adjacent ones of the upper and lower edge portions of the panel members such that the panel members are pivotable relative to the upper and lower rails about vertical axes. The locking members are mounted on the slidable rail units, and are operable to lock selectively the slidable rail units to the panel members and to the outer frame.

7 Claims, 13 Drawing Sheets

CLOSURE ASSEMBLY FOR SPANNING A WALL OPENING

BACKGROUND OF THE INVENTION

1. Field of the Invention

The present invention relates to a closure assembly, such as a door assembly or a window assembly, for spanning a wall opening and operable in different manners to form openings or entrances of different sizes.

2. Description of the Related Art

FIG. 1 illustrates a conventional hinged window 10 which includes a fixed outer frame 11 mounted in a wall opening (not shown), a window panel 12 hinged to the outer frame 11, and a linking member 13 for connecting a lower edge portion 122 of the window panel 12 to a bottom frame member 112 of the outer frame 11. The window 10 is operable in a single manner by moving the window panel 12 pivotally relative to the outer frame 11 to form an opening and to close the opening. FIG. 2 illustrates a slidable door 20 which includes a fixed outer frame 21 mounted securely inawall opening. The outer frame 21 has top and bottom frame members 211, 212, each of which is formed with parallel slide grooves for retaining slidably two vertically disposed door panels 22, 23 within the outer frame 21 such that the door panels 22, 23 are slidable along the slide grooves. The door panels 22, 23 have overlapping vertical frame members 221, 231 which are provided with a locking unit 24 for locking the door panels 22, 23 in a closed state. Referring to FIG. 3, to open the door 20, one of the door panels 22 is pulled to slide along the respective slide groove in the top and bottom frame members 211, 212 and to be disposed on one side of the other door panel 23. An entrance 215 generally as wide as the door panels 22, 23 is thus formed.

However, each of the conventional window 10 of FIG. 1 and the conventional door 20 of FIGS. 2 and 3 is operable in only a single manner to form an opening or entrance of a certain size. It is desirable to provide a closure assembly which is operable in more than one mode to form openings or entrances of different sizes as desired.

SUMMARY OF THE INVENTION

Therefore, the main object of the present invention is to provide a closure assembly which is operable in different manners to provide openings or entrances of different sizes as desired.

Accordingly, the closure assembly of the present invention includes a rectangular outer frame, at least two rectangular panel members, at least two slidable rail units, at least two pivot linking units, and at least two locking members. The outer frame has elongated and horizontally disposed top and bottom frame members, and opposite vertically disposed lateral members that interconnect the top and bottom frame members. The top and bottom frame members have confronting rail mounting surfaces, each of which is formed with a slide groove unit. The panel members are disposed vertically within the outer frame. Each of the panel members has an upper edge portion and a lower edge portion. Each of the slidable rail units includes an upper rail disposed between the top frame member of the outer frame and the upper edge portion of a respective one of the panel members, and a lower rail disposed between the bottom frame member of the outer frame and the lower edge portion of the respective one of the panel members. Each of the upper and lower rails is provided with a rolling ball unit which extends slidingly into the slide groove unit in a respective one of the top and bottom frame members of the outer frame. Each of the pivot linking units connects the upper and lower rails of a respective one of the slidable rail units to adjacent ones of the upper and lower edge portions of a respective one of the panel members such that the panel members are pivotable relative to the upper and lower rails of the respective one of the slidable rail units about vertical axes. Each of the locking members is mounted on a respective one of the slidable rail units, and is operable to lock selectively the respective one of the slidable rail units to the respective one of the panel members, thereby preventing pivoting movement of the respective one of the panel members relative to the respective one of the slidable rail units while permitting sliding movement of the respective one of the slidable rail units along the slide groove units in the top and bottom frame members of the outer frame. Each of the locking members is further operable to lock selectively the respective one of the slidable rail units to the outer frame, thereby permitting pivoting movement of the respective one of the panel members relative to the respective one of the slidable rail units while preventing sliding movement of the respective one of the slidable rail units along the slide groove units in the top and bottom frame members of the outer frame.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
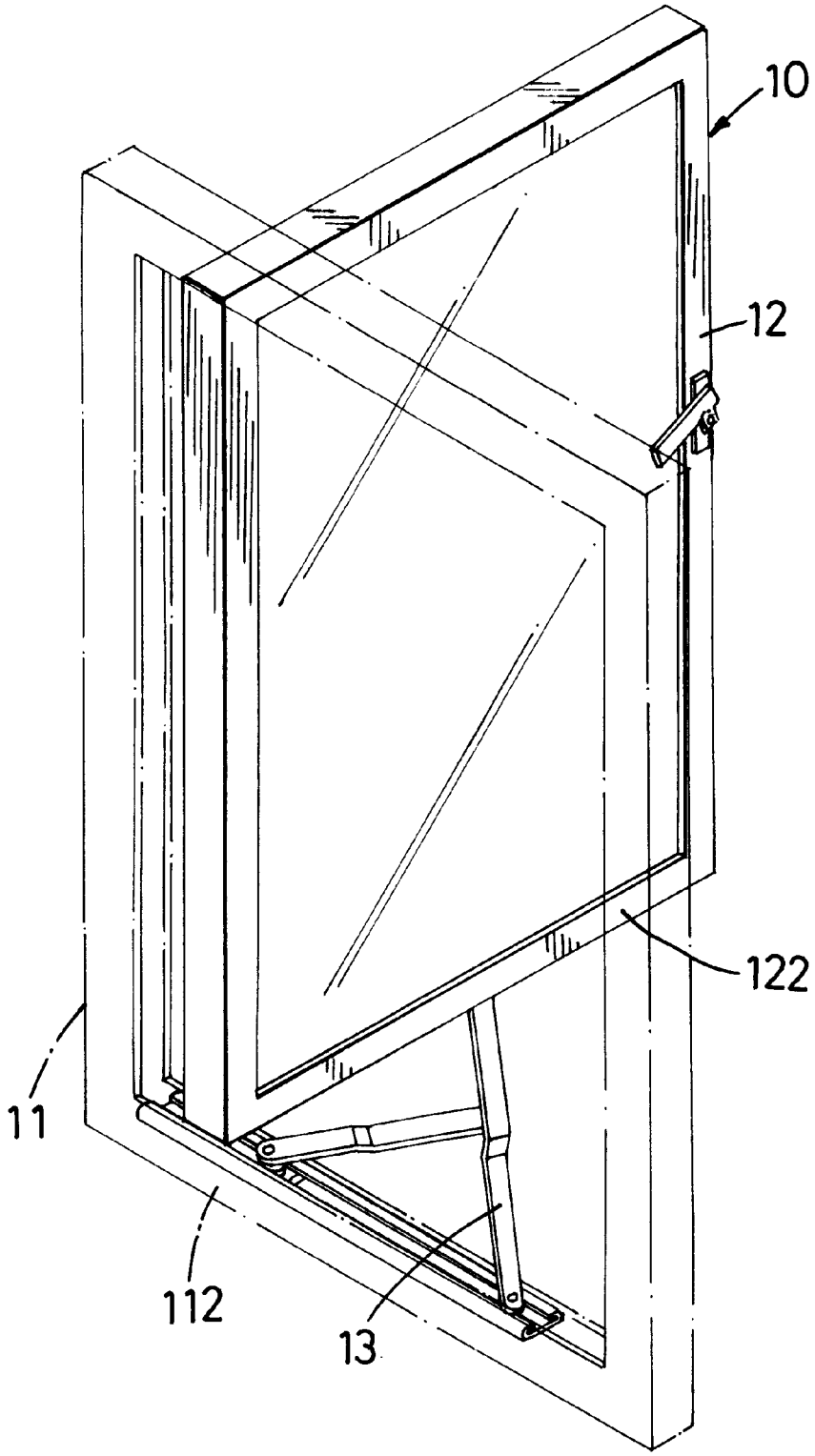
FIG.1 PRIOR ART
FIG. 1 is a perspective view of a conventional hinged window.
Figure 2:
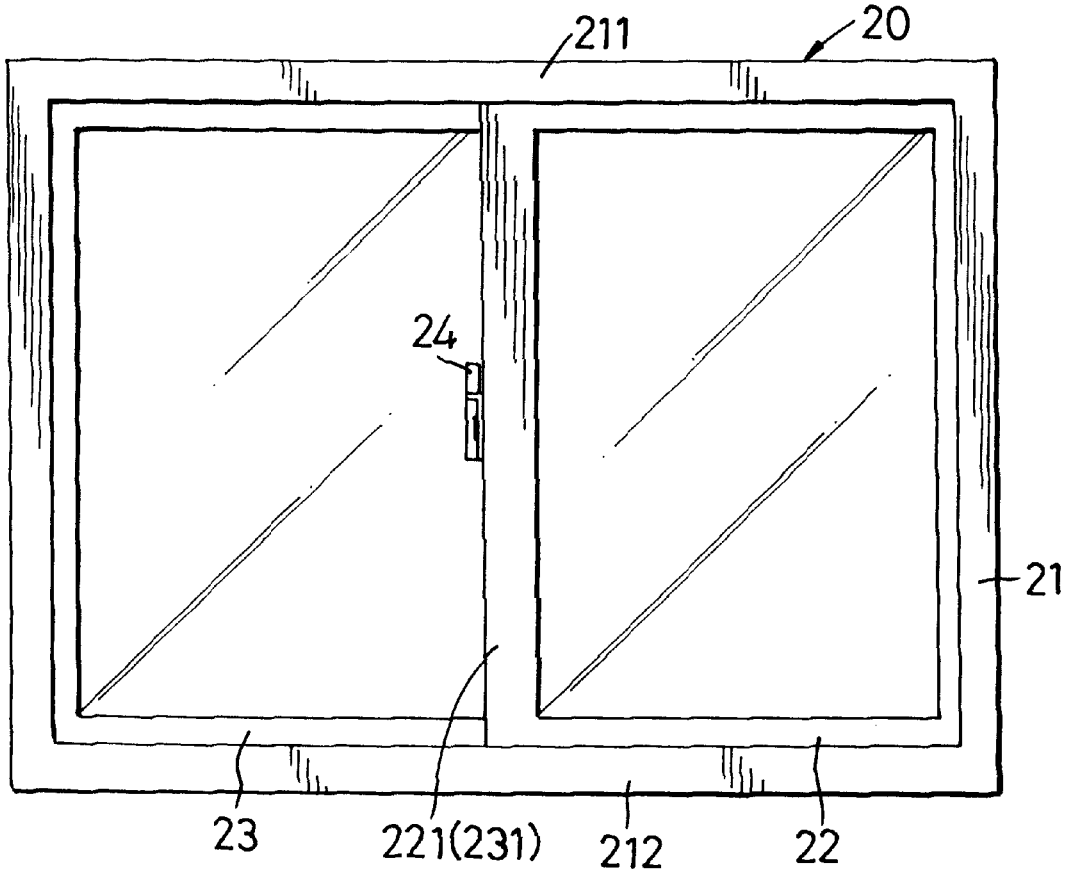
FIG.2 PRIOR ART
FIG. 2 is a schematic view of a conventional slidable door in a closed state.
Figure 3:
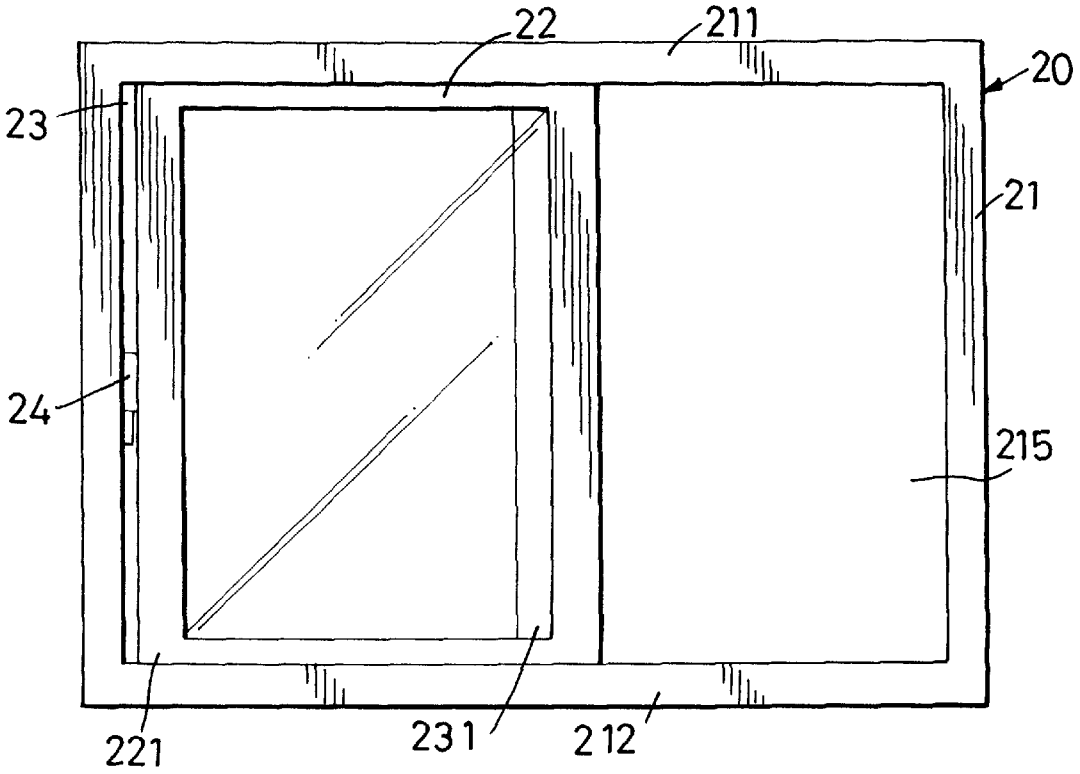
FIG.3 PRIOR ART
FIG. 3 is a schematic view of the conventional slidable door in an open state.
Figure 4B:
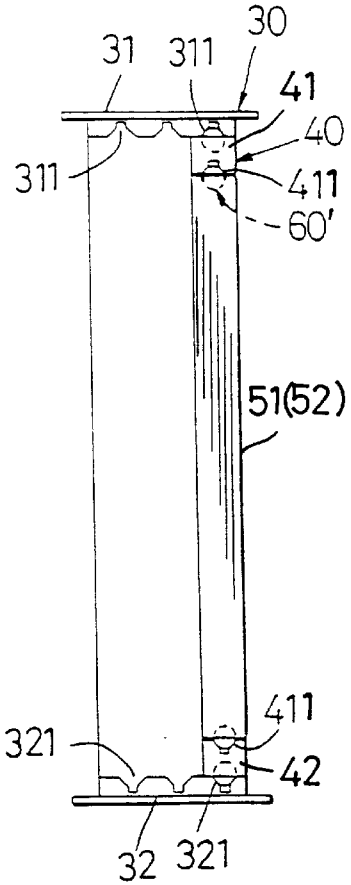
FIG. 4B is a schematic side view of the first preferred embodiment.
Figure 4A:
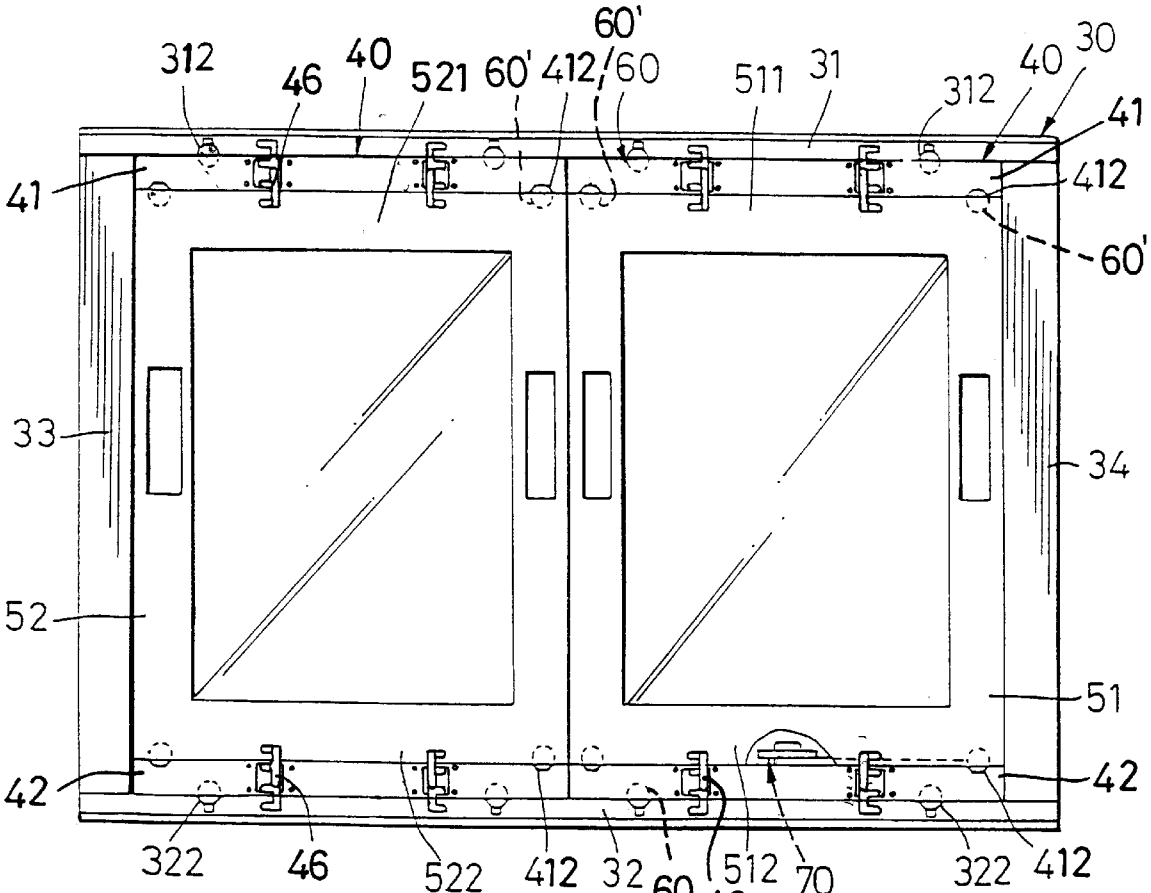
FIG. 4A is a schematic front view of a first preferred embodiment of the closure assembly of the present invention.

Referring to FIGS. 4A and 4B, the first preferred embodiment of the closure assembly of the present invention is shown to be in the form of a door that includes a rectangular outer frame 30, two rectangular panel members 51, 52, two slidable rail units 40, two pivot linking units 70 (only one is shown in FIG. 4A), and a plurality of operable locking members 46.

The outer frame 30 is fixed in a wall opening, and includes elongated and horizontally disposed top and bottom frame members 31, 32, and opposite vertically disposed lateral frame members 33, 34 interconnecting the top and bottom frame members 31, 32. Each of the top and bottom frame members 31, 32 has a rail mounting surface facing the other one of the top and bottom frame members 31, 32 and formed with a slide groove unit that includes three longitudinally extending first groove portions 311, 321 that are parallel to and that are spaced apart from each other, and four second groove portions 312, 322 transverse to and communicated with the first groove portions 311, 321. Each of the first and second groove portions 311, 321, 312, 322 has a generally V-shaped cross-section.

Each of the panel members 51, 52 is disposed vertically between the top and bottom frame members 31, 32 of the outer frame 30, and has an upper edge portion 511, 521, and a lower edge portion 512, 522.

Figure 5:
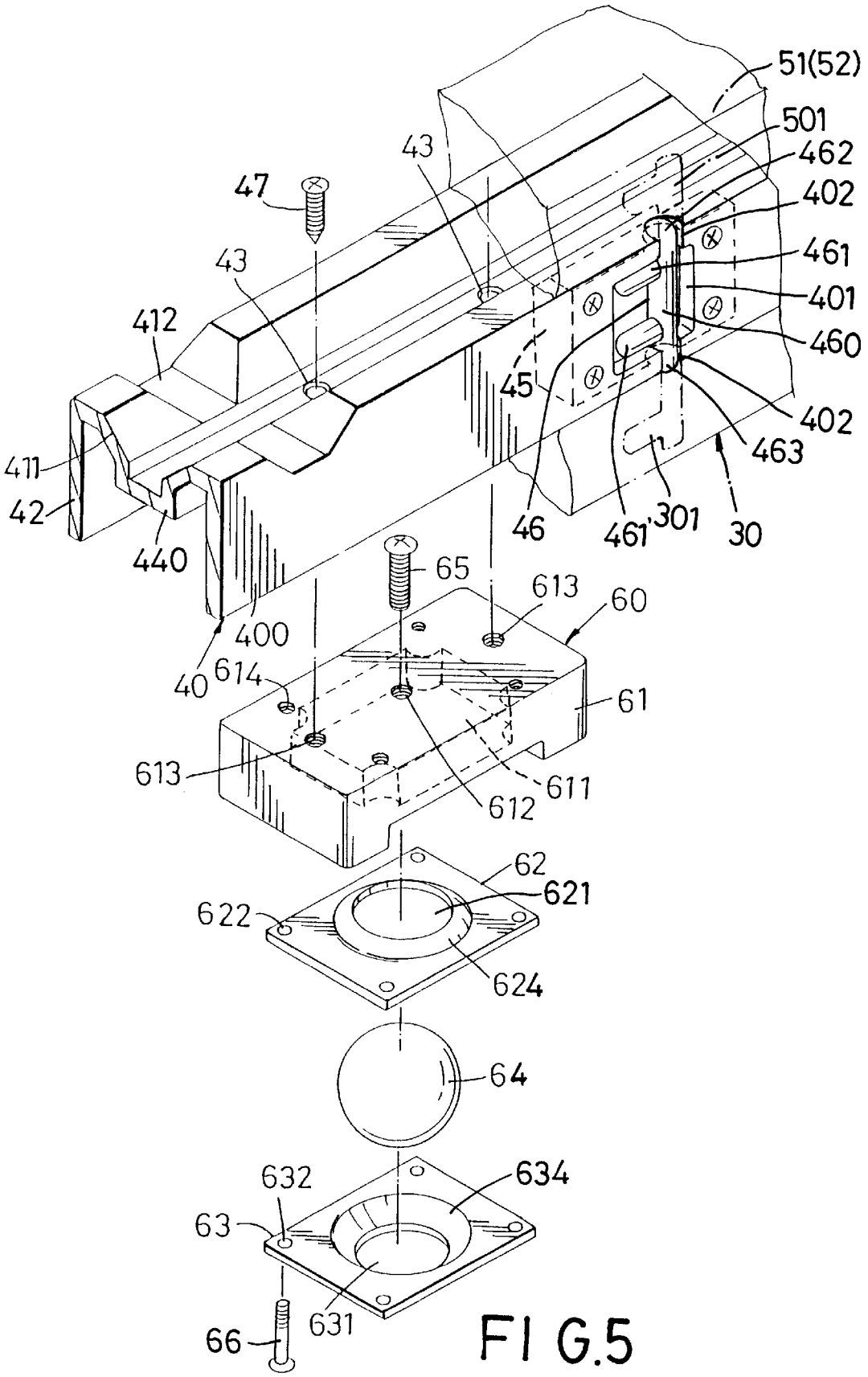
FIG. 5 is a fragmentary exploded perspective view illustrating a rolling ball unit and a slidable rail unit of the closure assembly of the first preferred embodiment.

Each of the slidable rail units 40 includes an upper rail 41 disposed between the top frame member 31 of the outer frame 30 and the upper edge portion 511, 521 of a respective one of the panel members 51, 52, and a lower rail 42 disposed between the bottom frame member 32 of the outer frame 30 and the lower edge portion 512, 522 of a respective one of the panel members 51, 52. Each of the upper and lower rails 41, 42 has a length equal to the length of an adjacent one of the upper and lower edge portions 511, 521, 512, 522 of the panel members 51, 52. Referring to FIGS. 4A and 5, each of the upper and lower rails 41, 42 of each of the slidable rail units 40 includes parallel front and rear walls 400, and a bridging wall 440 interconnecting the front and rear walls 400 and confronting the respective one of the panel members 51, 52. The bridging wall 440 of each of the upper and lower rails 41, 42 is formed with a longitudinally extending first groove 411 and a pair of second grooves 412 (only one is shown in FIG. 5) transverse to and communicated with the first groove 41. Each of the first and second grooves 411, 412 has a generally V-shaped cross-section. The front wall 400 has an outer surface formed with a slot 401, and a pair of communicating holes 402 at upper and lower portions of a periphery that defines the slot 401. The front wall 400 has a casing 45 mounted on an inner surface thereof around the slot 401. An operable locking member 46 is retained movably in the slot 401. The locking member 46 has a cylindrical locking rod portion 460 with opposite first and second end portions 462, 463 extending into the communicating holes 402, and first and second branch portions 461, 461' which extend transversely from the locking rod portion 460 and which can be received in the slot 401. Each of the communicating holes 402 is defined by a generally c-shaped peripheral wall, and has an open side which is formed in the front wall 400 and which is narrower than the diameter of the locking rod portion 460 so as to prevent removal of the locking member 46 from the slot 401. The locking member 46 is rotatable about an axis of the locking rod portion 460 to move the branch portions 461, 461' outwardly and inwardly of the slot 401. Each of the upper and lower edge portions 511, 521, 512, 522 of each of the panel members 51, 52 is formed with a locking hole 501 communicated with an adjacent one of the communicating holes 402 in an adjacent one of the upper and lower rails 41, 42 of the slidable rail units 40 for receiving the first end portion 462 of the locking rod portion 460 and the first branch portion 461 of the respective one of the locking members 46 so as to lock the respective one of the slidable rail units 40 to the respective one of the panel members 51, 52. Each of the top and bottom frame members 31, 32 of the outer frame 30 is formed with a locking hole 301 communicated with an adjacent one of the communicating holes 402 in an adjacent one of the upper and lower rails 41, 42 of the slidable rail units 40 for receiving the second end portion 463 of the locking rod portion 460 and the second branch portion 461' of the locking member 46 so as to lock the respective one of the upper and lower rails 41, 42 to the respective one of the top and bottom frame members 31, 32 of the outer frame 30.

Each of the upper and rails 41, 42 of the slidable rail units 40 is provided with a pair of rolling ball units 60 (only one is shown in FIG. 5). The rolling ball units 60 are disposed among the front and rear walls 400, the bridging wall 440 and an adjacent one of the top and bottom frame members 31, 32 of the outer frame 30. Each of the rolling ball units 60 includes a mounting frame 61, a pair of retaining plates 62, 63, and a ball member 64 held rotatably by the retaining plates 62, 63. The mounting frame 61 is fastened to the bridging wall 440 by means a pair of screws 47 (only one is shown in FIG. 5) that extend through a pair of fastener holes 43 formed in the bridging wall 440 within the first groove 411 and that engage a pair of threaded holes 613 formed in the mounting frame 61. The mounting frame 61 has one side facing the adjacent one of the top and bottom frame members 31, 32 and formed with a cavity 611. The mounting frame 61 has a threaded adjusting hole 612 that extends to the cavity 611 for receiving an adjusting member 65, which is in the form of a screw bolt. The retaining plates 62, 63 are fastened to the mounting frame 61 by screw members 66 that extend through fastener holes 632, 622 at four corners of the retaining plates 63, 62 and that engage threaded holes 614 formed in four corners of the mounting frame 61 externally of the cavity 611. The retaining plates 62, 63 are formed with aligned circular openings 621, 631, and annular retaining flanges 624, 634 around the central openings 621, 631. The retaining flanges 624, 634 are curved, and are in rolling contact with the ball member 64 such that the ball member 64 can be held rotatably by the retaining plates 62, 63 and such that the ball member 64 has opposite portions projecting from the annular retaining flanges 624, 634. One of the opposite portions extends into the cavity 611. The other one of the opposite portions extends into the sliding groove unit in an adjacent one of the top and bottom frame members 31, 32 of the outer frame 30. The ball member 64 is slidable along each of the first groove portions 311, 321 of the slide groove unit, and further along each of the second groove portions 312, 322 for movement from one of the first groove portions 311, 321 to another one of the first groove portions 311, 321. The adjusting member 65 is extendible into the cavity 611 for abutting against the ball member 64 to adjust mobility of the ball member 64. The cavity 611 may be filled with a lubricant to lubricate the ball member 64.

Figure 6:
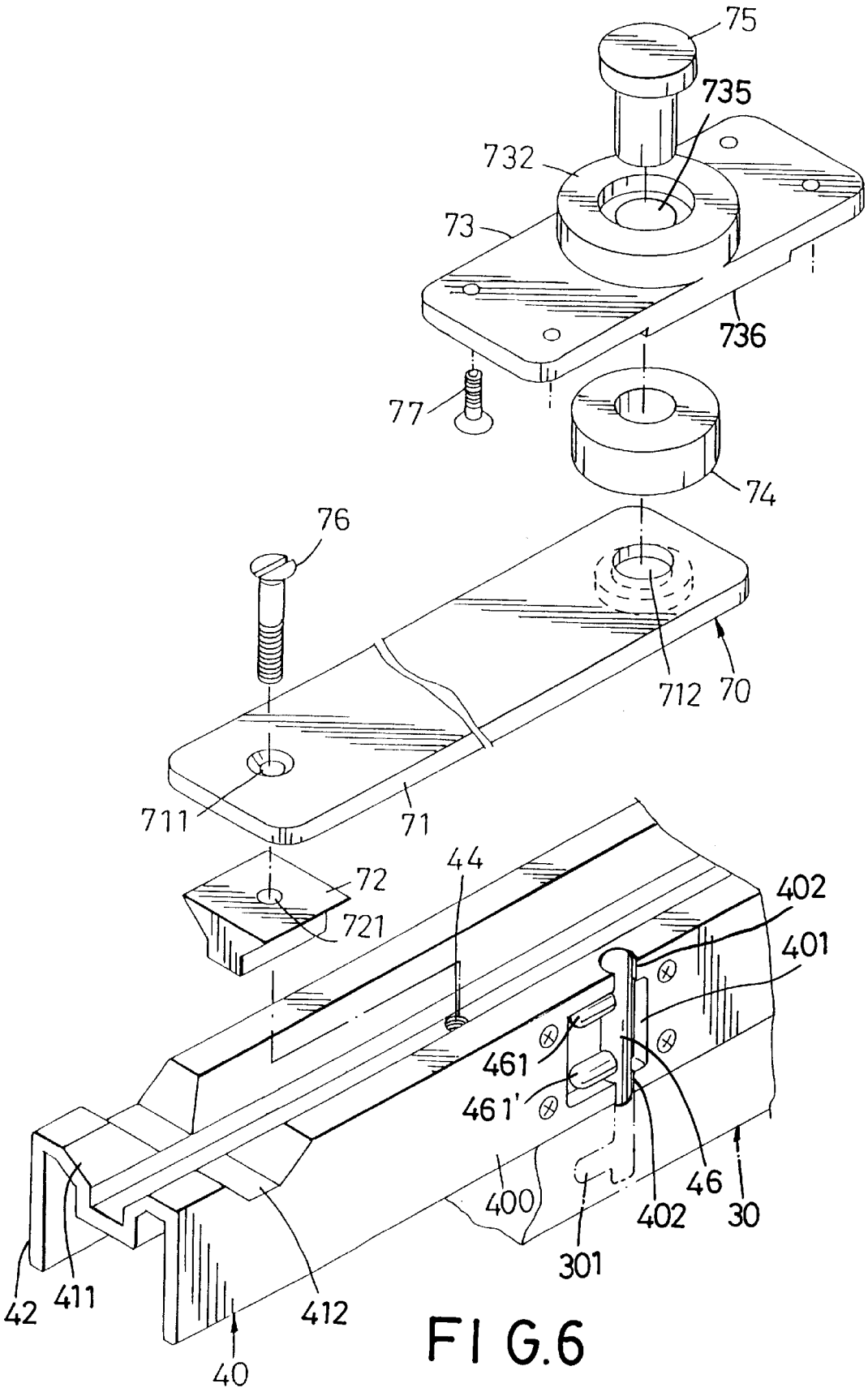
FIG. 6 is another fragmentary exploded perspective view illustrating a pivot linking unit and the slidable rail unit of the closure assembly of the first preferred embodiment.
Figure 7:
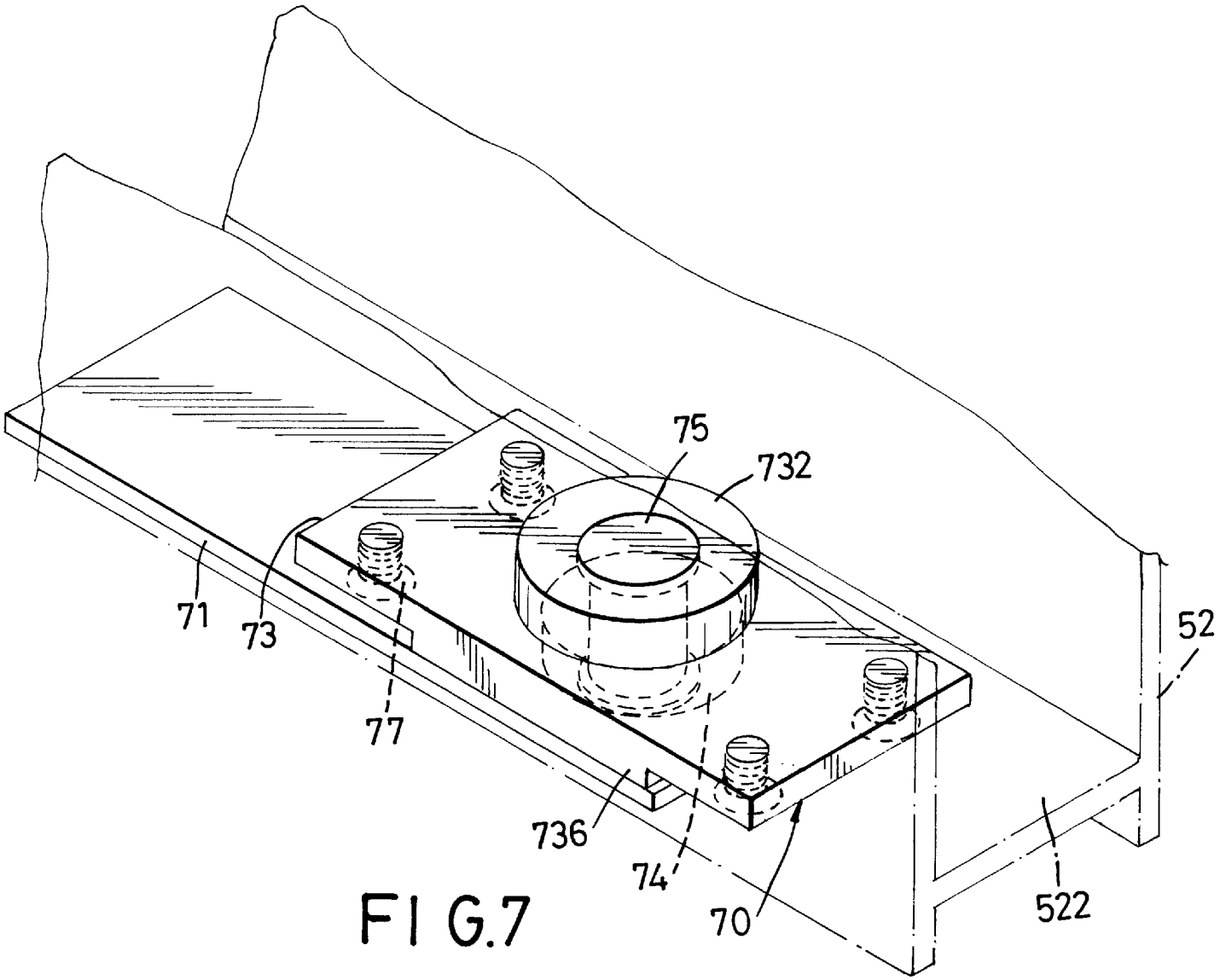
FIG. 7 is a fragmentary perspective view illustrating the pivot linking unit and a panel member.
Figure 8:
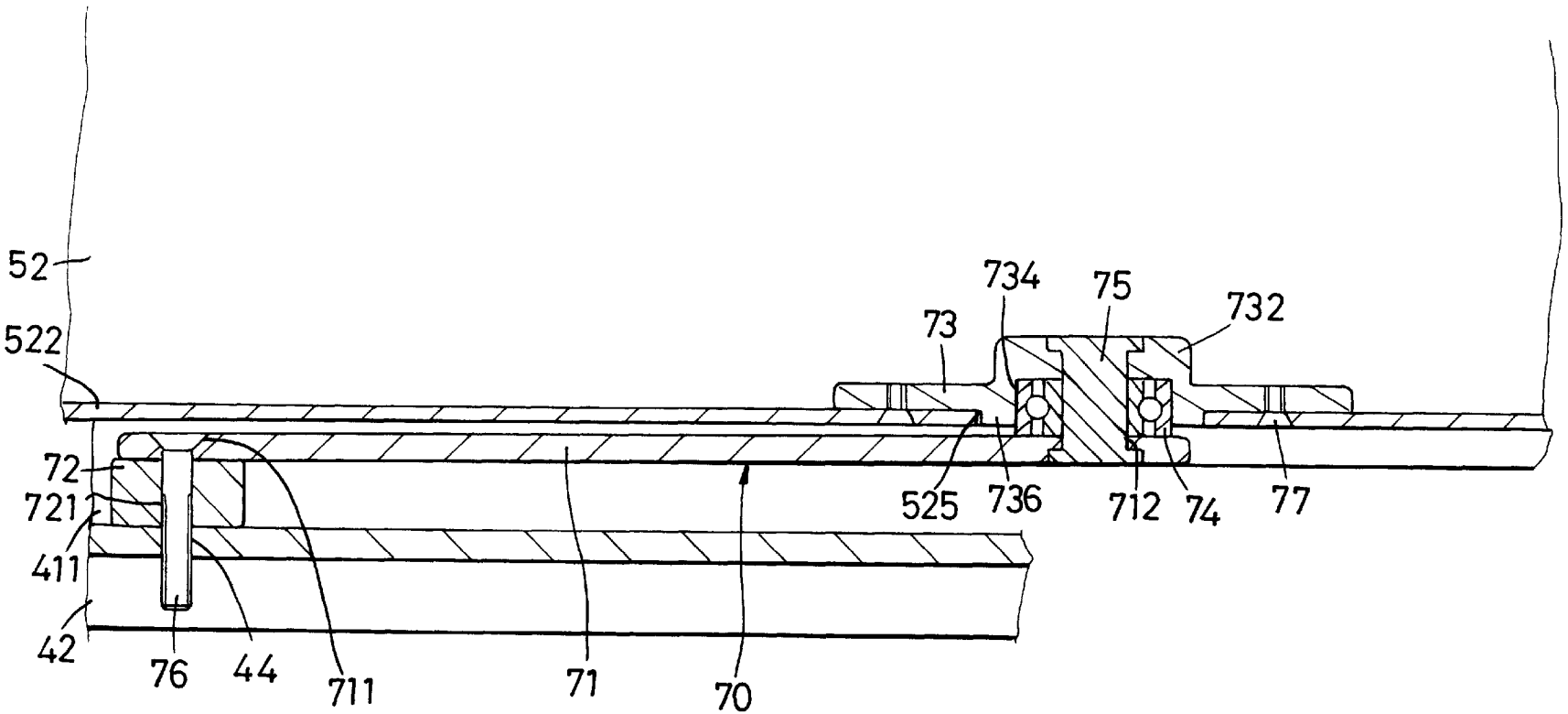
FIG. 8 is a fragmentary sectional view illustrating the pivot linking unit and the panel member.

Referring to FIGS. 6 to 8, each of the pivot linking unit 70 includes a pair of elongated linking plates 71 (only one is shown), a pair of pivot plates 73 (only one is shown), a pair of bearings 74 (only one is shown), a pair of pivot axles 75 (only one is shown) and a pair of packing members 72 (only one is shown) Each of the packing members 72 has a cross-section conforming with that of the first groove 411 in a respective one of the upper and lower rails 41, 42, and is received in the first groove 411 of the respective one of the upper and lower rails 41, 42. Each of the packing members 72 is formed with a fastener hole 721 therethrough. Each of the linking plates 71 is disposed between the respective one of the panel members 51, 52 and an adjacent one of the upper and lower rails 41, 42 of a respective one of the slidable rail units 40, and extends in a direction along the respective one of the upper and lower rails 41, 42. Each of the linking plates 71 has a length equal to half the length of the upper and lower rails 41, 42, and has a first end portion formed with a mounting hole 711 that is aligned with the fastener hole 721 in a respective one of the packing members 72, and a second end portion formed with a pivot hole 712. A mounting shaft 76 extends through the mounting hole 711 in a respective one of the linking plates 71, through the fastener hole 721 in a respective one of the packing members 72, and engages a threaded hole 44 in a respective one of the upper and lower rails 41, 42 for mounting the linking plate 71 on the respective one of the upper and lower rails 41, 42. The mounting shaft 76 has a threaded section engaging the respective one of the upper and lower rails 41, 42, and a non-threaded section extending rotatably through the mounting hole 711 in the first end portion of the respective one of the linking plates 71. Each of the pivot plates 73 has a mounting portion 732 which has a pivot hole 735 formed therethrough, and one side formed with a circular recess 734 for receiving a respective one of the bearings 74. Each of the pivot axles 75, which are in the form of rivets, extends through the pivot hole 735 in a respective one of the pivot plates 73, a respective one of the bearings 74, and the pivot hole 712 in the second end portion of a respective one of the linking plates 71, and has a first end secured to the respective linking plate 71 and a second end extending rotatably through the respective pivot plate 73 for mounting the respective pivot plate 73 pivotally on the second end portion of the respective linking plate 71. The pivot plate 73 has a rectangular projection 736 which extends through a rectangular opening 525 in a peripheral wall at an adjacent one of the upper and lower edge portions 511, 512, 521, 522 of the panels members 51, 52. The pivot plate 73 is fastened to the peripheral wall of the adjacent edge portion 511, 512, 521, 522 by means of four screw fasteners 77.

Referring once more to FIG. 4A, to facilitate pivoting movement of the panel members 51, 52 relative to the upper and lower rails 41, 42 of the slidable rail units 40, each of the upper and lower edge portions 511, 521, 512, 522 is further provided with a pair of the rolling ball units 60' that extend respectively into the second grooves 412 in an adjacent one of the upper and lower rails 41, 42 and that are slidable along the second grooves 412 during pivoting movement of the panel members 51, 52 relative to the slidable rail units 40.

Referring again to FIGS. 4A and 5, in assembly, the rolling ball units 60 are fastened to the upper and lower rails 41, 42 by means of the fasteners 47. In a similar manner, a plurality of the rolling ball units 60' are fastened to the upper and lower edge portions 511, 521, 512, 522 of the panel members 51, 52. Then, the pivot linking units 70 are mounted between the panels members 51, 52 and the upper and lower rails 41, 42 for connecting the panels 51, 52 to the slidable rail units 40. Referring to FIGS. 7 and 8, the rectangular protrusion 736 of each of the pivot plates 73 is extended through the rectangular opening 525 in the adjacent one of the upper and lower edge portions 511, 521, 512, 522 of the panel members 51, 52. Each of the pivot axles 75 is extended through a respective one of the pivot plates 73 and a respective one of the linking plates 71. Each of the mounting shafts 76 is extended through a respective one of the pivot plates 71, a respective one of the packing members 72, and into a respective one of the upper and lower rails 41, 42. Thereafter, the panels members 51, 52 together with the upper and lower rails 41, 42 of the slidable rail units 40 are disposed vertically within the outer frame 30, allowing the rolling ball units 60 on the slidable rail units 40 to extend into the slide groove units in the top and bottom frame members 31, 32 of the outer frame 30.

Referring to FIG. 5, in use, each of the locking members 46 is operable to move along the axis of the locking rod portion 460 between a first position where the first end portion 462 of the locking rod portion 460 and the first branch portion 461 of the locking member 46 extend into the locking hole 501 in a respective one of the panel members 51, 52 to lock the respective one of the slidable rail units 40 to the respective one of the panel members 51, 52, while the second end portion 463 of the locking rod portion 460 does not extend into the locking hole 301 in the adjacent one of the top and bottom frame members 31, 32 of the outer frame 30, and a second position where the second end portion 463 and the second branch portion 461' of the locking member 46 extend into the locking hole 301 in the adjacent one of the top and bottom frame members 31, 32 of the outer frame 30 to lock the respective one of the slidable rail units 40 to the outer frame 30, while the first end portion 462 of the locking rod portion 460 does not extend to the locking hole 501 in the adjacent one of the upper and lower edge portions 511, 521, 512, 522 of the respective one of the panel members 51, 52. Therefore, when the locking members 46 are in the first position, pivoting movement of the respective one of the panel members 51, 52 relative to the respective one of the slidable rail units 40 is prevented, while sliding movement of the respective one of the slidable rail units 40 along the slide groove units in the top and bottom frame members 31, 32 of the outer frame 30 is permitted. When the locking members 46 are in the second position, sliding movement of the respective one of the slidable rail units 40 along the slide groove units in the top and bottom frame members 31, 32 of the outer frame 30 is prevented, while pivoting movement of the respective one of the panel members 51, 52 relative to the respective one of the slidable rail units 40 is permitted.

Before each of the locking members 46 can be operated, the locking member 46 is turned about an axis of the locking rod portion 460 to move the branch portions 461, 461' out of the slot 401. After the locking member 46 is moved to a selected one of the first and second positions, the locking member 46 can be turned back to dispose the branch portions 461, 461' respectively in the slot 401 and in one of the locking holes 301, 501.

Figure 9B:
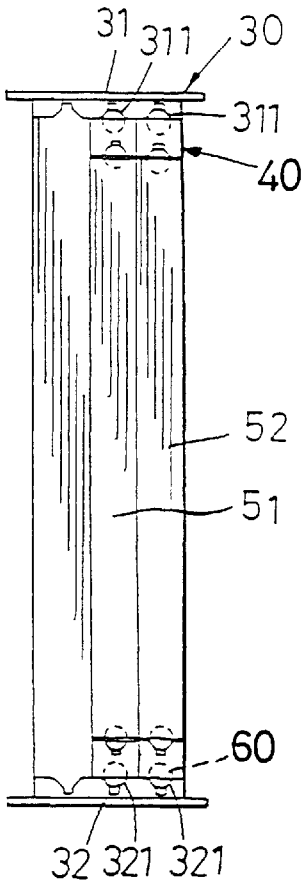
FIG. 9B is schematic side view illustrating the first preferred embodiment when operated in the first mode.
Figure 9A:
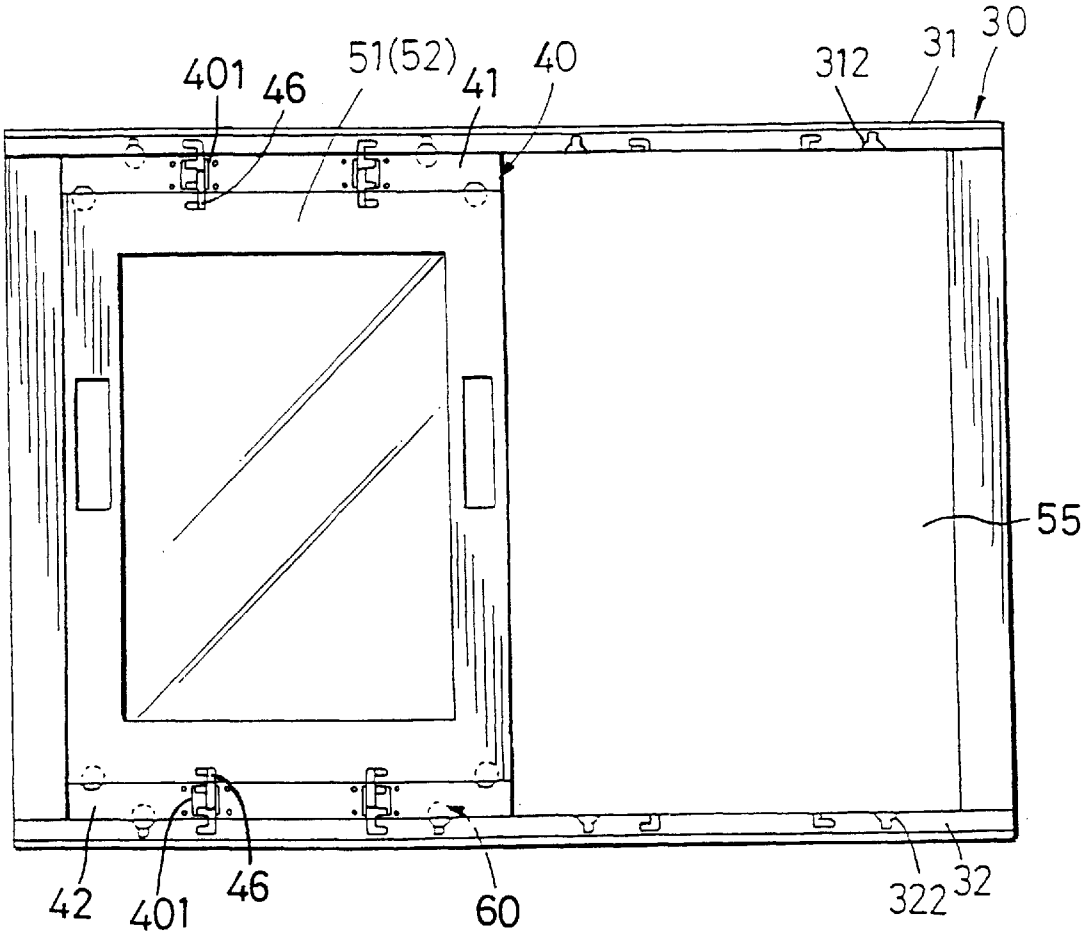
FIG. 9A is a schematic front view illustrating the first preferred embodiment when operated in a first mode.

Referring to FIGS. 9A and 9B, when the closure assembly of the preferred embodiment is operated in a first mode, the locking members 46 are moved to the first position such that the panel members 51, 52 are locked to the upper and lower rails 41, 42 of a respective one of the slidable rail units 40. At this time, the slidable rail units 40 and the panel members 51, 52 locked thereto can be slid along the first groove portions 311, 321 and further along the second groove portions 312, 322 of the slide groove units by means of the rolling ball units 60 that are mounted on the upper and lower rails 41, 42 so as to dispose the slidable rail units 40 in different ones of the first groove portions 311, 321, and to dispose the panel members 51, 52 in parallel vertical planes. One of the panel members 51, 52 can be moved to one side of the other one of the panel members 51, 52 to form an entrance 55 through the closure assembly.

Figure 10B:
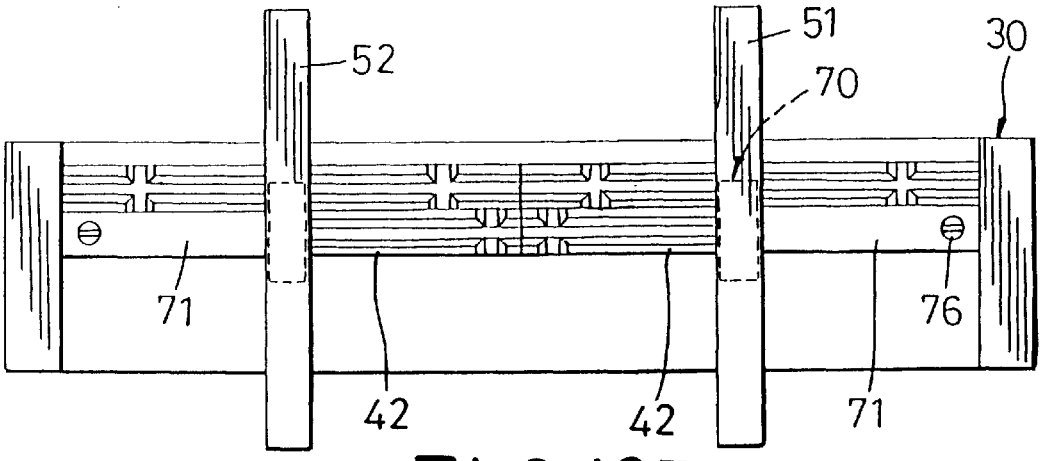
FIG. 10B is a top view illustrating the first preferred embodiment when operated in the second mode.
Figure 10A:
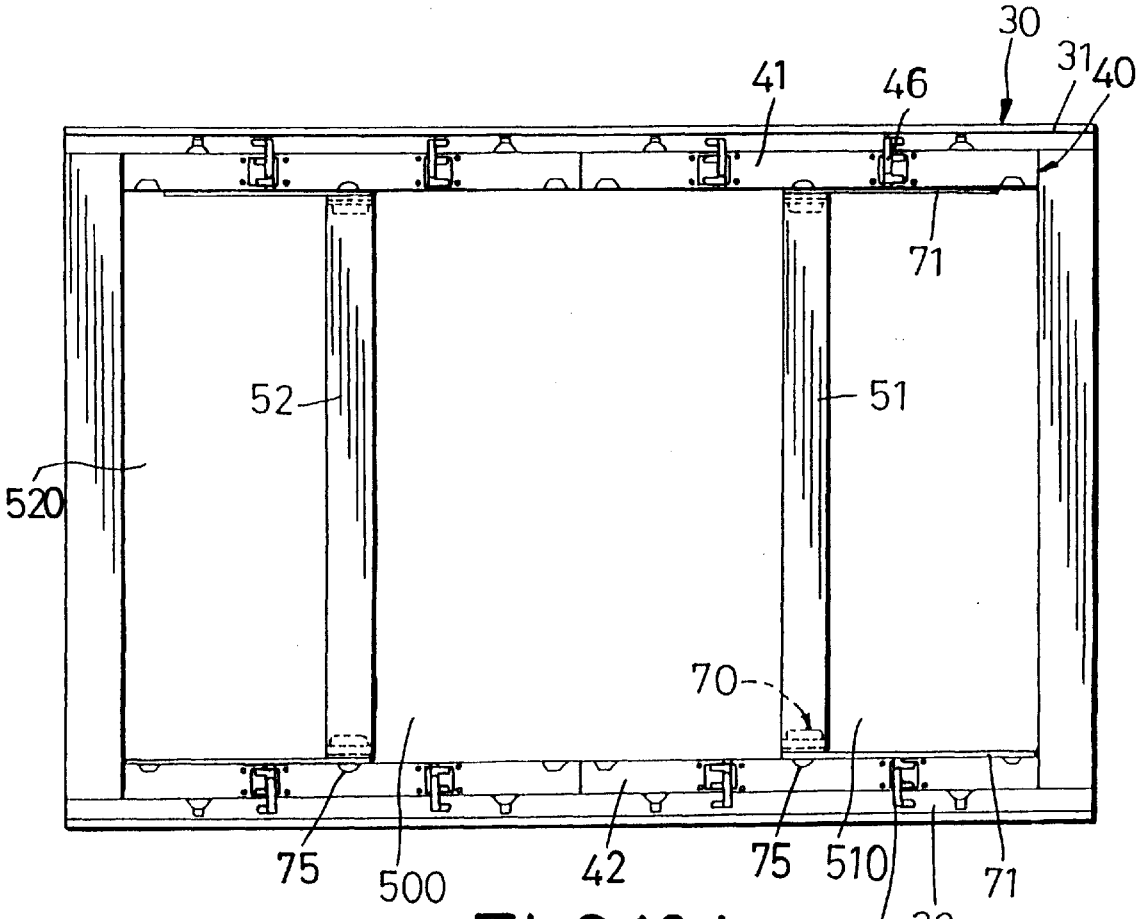
FIG. 10A is a schematic front view illustrating the first preferred embodiment when operated in a second mode.

Referring to FIGS. 10A and 10B, in a second mode, the locking members 46 are moved to the second position such that the upper and lower rails 41, 42 of the slidable rail units 40 are locked to the top and bottom frame members 31, 32 of the outer frame 30. At this time, the panel members 51, 52 are pivotable about the axles 75 to form an opening which is divided into three parts 520, 500, 510 by the panel members 51, 52.

Figure 11B:
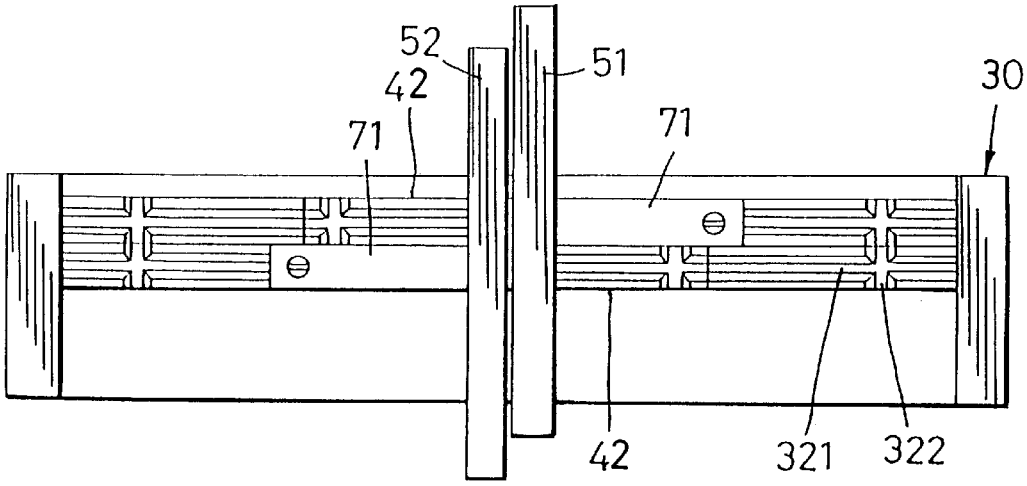
FIG. 11B is a top view illustrating the first preferred embodiment when operated in the third mode.
Figure 11A:
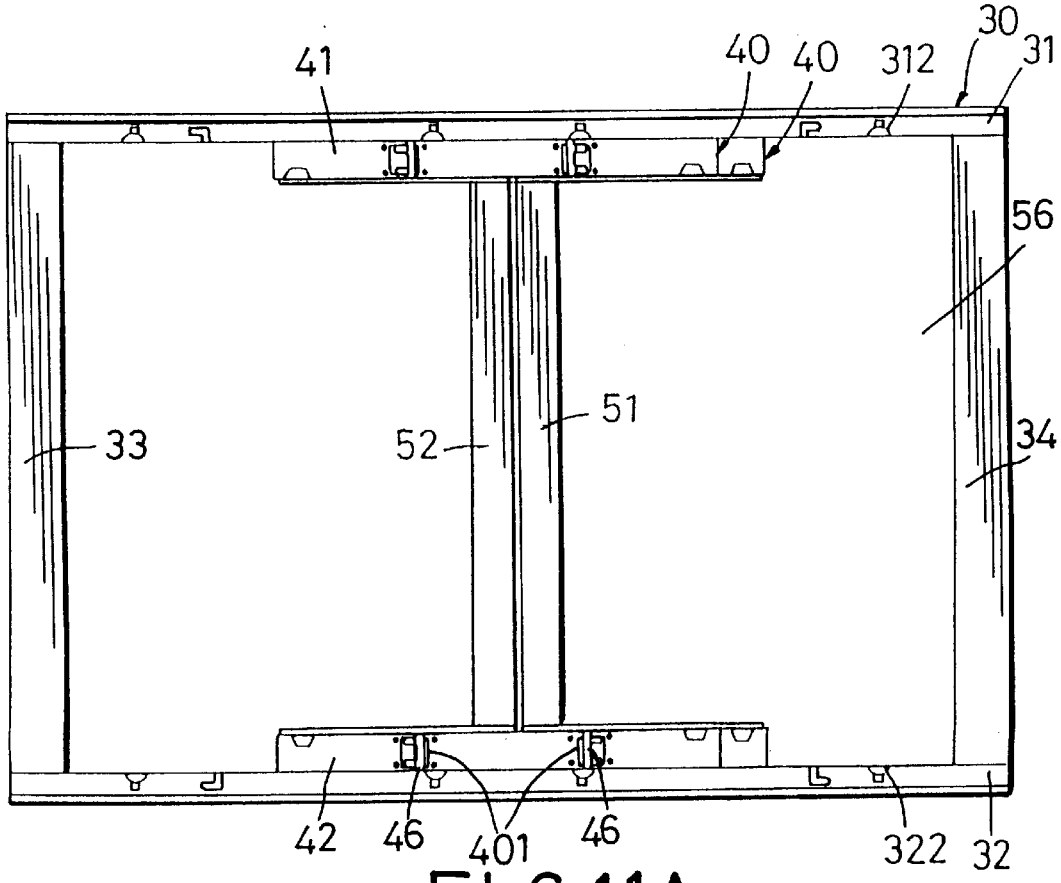
FIG. 11A is a schematic front view illustrating the first preferred embodiment when operated in a third mode.

Referring to FIGS. 11A and 11B, in a third mode, the locking members 46 are moved to the first position to lock the upper and lower rails 41, 42 of the slidable rail units 40 to the panel members 51, 52. Then, the upper and lower rails 41, 42 are slid along the first and second groove portions 311, 312, 321, 322 of the slide groove units in the top and bottom frame members 31, 32 of the outer frame 30 such that the panel members 51, 52 are disposed at intermediate sections of different ones of the first grooves 311, 321 and overlap with each other. Thereafter, the locking members 46 are moved to the second position to unlock the panel members 51, 52 from the upper and lower rails 41, 42 and to lock the upper and lower rails 41, 42 to the outer frame 30. The panel members 51, 52 are then turned pivotally about the pivot axles 75 to cooperatively form a partition wall in an entrance 56 formed between the lateral members 33, 34 of the outer frame 30.

Figure 12B:
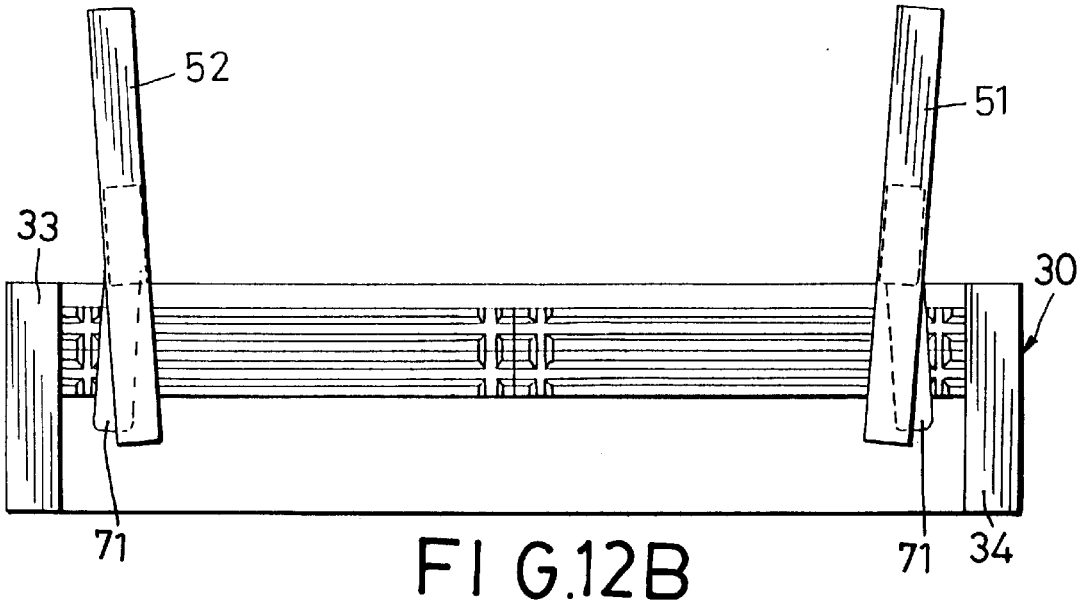
FIG. 12B is a top view illustrating the first preferred embodiment when operated in the fourth mode.
Figure 12A:
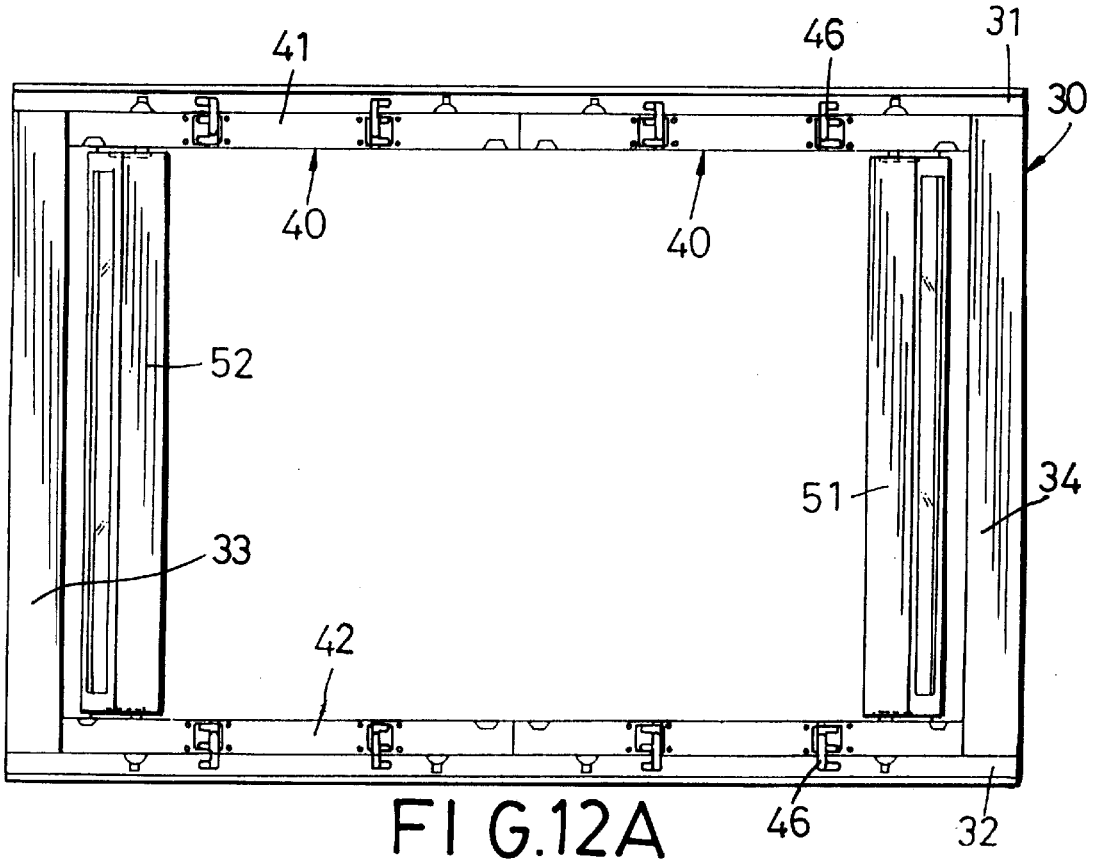
FIG. 12A is a schematic front view illustrating the first preferred embodiment when operated in a fourth mode.

Referring to FIGS. 12A and 12B, in yet another mode of use, the panel members 51, 52 are turned about the pivot axles 75 and the linking plates 71 are moved pivotally about the mounting shafts 76 so as to move the panel members 51, 52 to lateral sides of the closure assembly to provide an entrance of a relatively large size between the panel members 51, 52.

Figure 13:
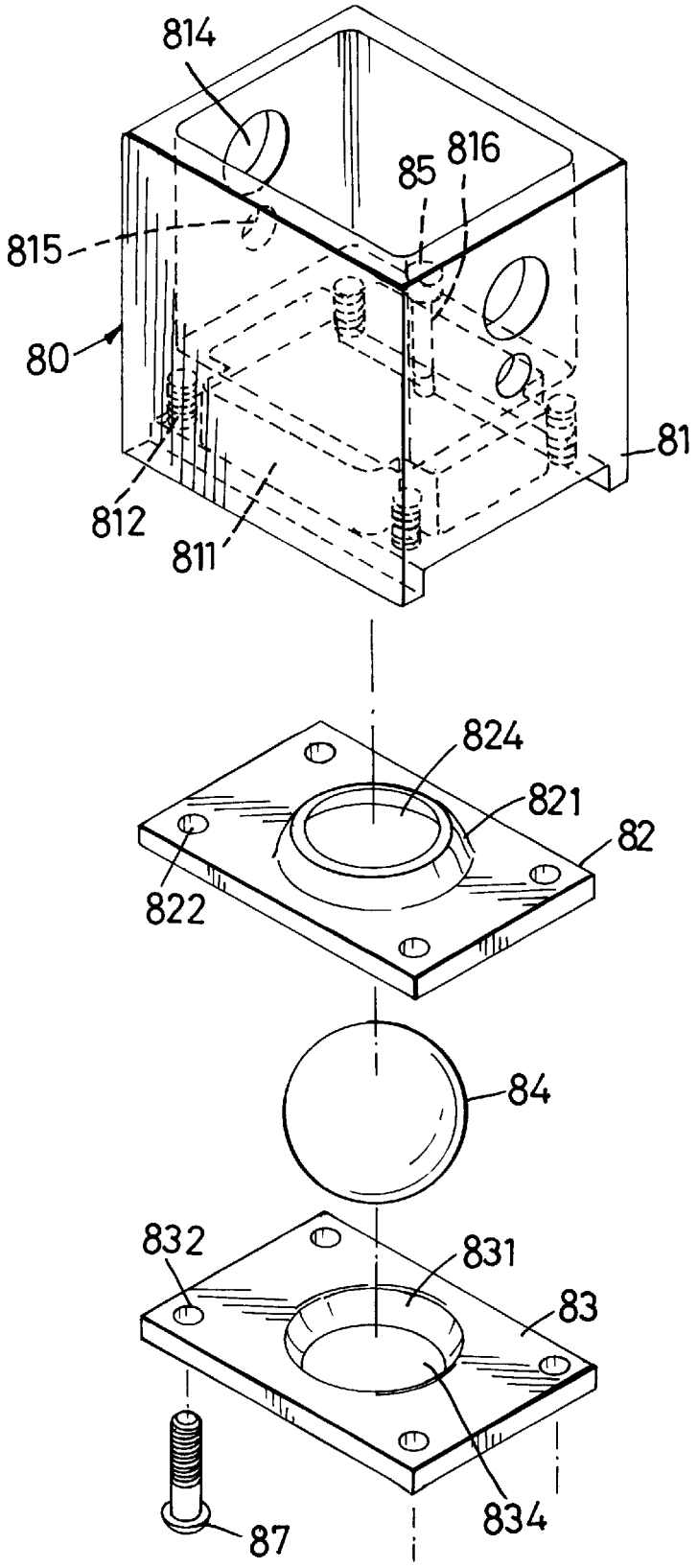
FIG. 13 is an exploded perspective view illustrating a rolling ball unit mounted on the panel members of a modified preferred embodiment.

Referring to FIG. 13, in another preferred embodiment, another kind of rolling ball unit 80 is provided to be disposed between the panel members 51, 52 and the upper and lower rails 41, 42 (see FIG. 4). The rolling ball unit 80 is shown to include a mounting frame 81, a pair of retaining plates 82, 83, a ball member 84, and an adjusting bolt 85. The mounting frame 81 is to be mounted on a respective one of the upper and lower edge portions 511, 512, 521, 522 of the panel members 51, 52 by extending fasteners (not shown) through mounting holes 814, 815 thereof, and is formed with a cavity 811. The retaining plates 82, 83 are fastened to the mounting frame 81 by means of screw fasteners 87 (only one is shown) that extend through fastener holes 832, 822 in four corners of the retaining plates 83, 82 and threaded holes 812 in four corners of the mounting frame 81 externally of the cavity 811. Each of the retaining plates 82, 83 is formed with a circular opening 824, 834, and an annular retaining flange 821, 831 around the opening 824, 834 for rolling contact with the ball member 84. The ball member 84 is rotatably held by the retaining plates 82, 83. The adjusting bolt 85 extends through an adjusting hole 816 in the mounting frame 81, and is operable to adjust the distance between the retaining plates 82, 83 so as to adjust the mobility of the ball member 84.

It has been shown that, by operating the locking members 46 to lock selectively the slidable rail units 40 to the respective one of the panel members 51, 52 and to the outer frame 30, the closure assembly of the present invention can be operated in different modes as desired to form openings or entrances of different sizes and shapes as required.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A closure assembly comprising:

a rectangular outer frame having elongated and horizontally disposed top and bottom frame members, and opposite vertically disposed lateral members that interconnect said top and bottom frame members, said top and bottom frame members having confronting rail mounting surfaces, each of said rail mounting surfaces being formed with a slide groove unit;

at least two rectangular panel members disposed vertically within said outer frame, each of said panel members having an upper edge portion and a lower edge portion;

at least two slidable rail units, each of which includes an upper rail disposed between said top frame member of said outer frame and said upper edge portion of a respective one of said panel members, and a lower rail disposed between said bottom frame member of said outer frame and said lower edge portion of the respective one of said panel members, each of said upper and lower rails being provided with a rolling ball unit which extends slidingly into said slide groove unit in a respective one of said top and bottom frame members of said outer frame;

at least two pivot linking units, each of which connects said upper and lower rails of a respective one of said slidable rail units to adjacent ones of said upper and lower edge portions of a respective one of said panel members such that said panel members are pivotable relative to said upper and lower rails of the respective one of said slidable rail units about vertical axes; and at least two locking members, each of which is mounted on a respective one of said slidable rail units, and is operable to lock selectively the respective one of said slidable rail units to the respective one of said panel members, thereby preventing pivoting movement of the respective one of said panel members relative to the respective one of said slidable rail units while permitting sliding movement of the respective one of said slidable rail units along said slide groove units in said top and bottom frame members of said outer frame, and to said outer frame, thereby permitting pivoting movement of the respective one of said panel members relative to the respective one of said slidable rail units while preventing sliding movement of the respective one of said slidable rail units along said slide groove units in said top and bottom frame members of said outer frame.

2. The closure assembly according to claim 1, wherein said slide groove unit in each of said top and bottom frame members of said outer frame includes at least two longitudinally extending first groove portions that are parallel to and that are spaced apart from each other, and a second groove portion transverse to and communicated with said first groove portions, said rolling ball unit of each of said slidable rail units being slidable along said first groove portions and further along said second groove portion for movement from one of said first groove portions to another one of said first groove portions.

3. The closure assembly according to claim 1, wherein each of said upper and lower rails includes parallel front and rear walls, and a bridging wall interconnecting said front and rear walls and confronting the respective one of said panel members, said rolling ball unit being disposed between said front and rear walls of a respective one of said upper and lower rails and including a mounting frame fastened to the respective one of said upper and lower rails and formed with a cavity, a pair of retaining plates fastened to said mounting frame, and a ball member held rotatably by said retaining plates, said retaining plates being formed with aligned circular openings to permit opposite portions of said ball member to project therefrom such that one of said opposite portions of said ball member extends into said cavity and the other one of said opposite portions of said ball member extends into said slide groove unit in the respective one of said top and bottom frame members of said outer frame.

4. The closure assembly according to claim 3, wherein each of said retaining plates is further formed with an annular retaining flange around said circular opening and in rolling contact with said ball member.

5. The closure assembly according to claim 1, wherein each of said pivot linking units includes:

a pair of elongated linking plates, each of which is disposed between the respective one of said panel members and an adjacent one of said upper and lower rails of the respective one of said slidable rail units, and has a first end portion mounted on the adjacent one of said upper and lower rails, and an opposite second end portion;

a pair of pivot plates, each of which is fastened to one of said upper and lower edge portions of the respective one of said panel members; and a pair of vertically extending axles, each of which has a first end fixed to said second end portion of a respective one of said linking plates, and a second end extending rotatably through a respective one of said pivot plates.

6. The closure assembly according to claim 5, wherein each of said pivot linking units further includes a pair of mounting shafts, each of which is secured to one of said upper and lower rails of the respective one of said slidable rail units and extends rotatably through said first end portion of a respective one of said linking plates.

7. The closure assembly according to claim 1, wherein each of said upper and lower rails has a side wall formed with a slot, said top and bottom frame members of said outer frame and said upper and lower edge portions of said panel members being formed with locking holes, each of said locking members being received in said slot in one of said upper and lower rails of the respective one of said slidable rail units, and having opposite first and second end portions, said first end portion of each of said locking members being extendible into a corresponding said locking hole in the respective one of said panel members to lock the respective one of said slidable rail units to the respective one of said panel members, said second end portion of each of said locking members being extendible into a corresponding said locking hole in said outer frame to lock the respective one of said slidable rail units to said outer frame.

* * * * *